US005216970A

United States Patent [19]

Sakuma

[11] Patent Number: 5,216,970

[45] Date of Patent: Jun. 8, 1993

[54] MODE CHANGER WITH STITCH LENGTH, WIDTH, AND THREAD TENSION ADJUSTMENTS

[75] Inventor: Kouichi Sakuma, Yamagata, Japan

[73] Assignee: Suzuki Manufacturing, Ltd., Japan

[21] Appl. No.: 867,371

[22] Filed: Apr. 13, 1992

[30] Foreign Application Priority Data

Apr. 12, 1991 [JP] Japan ..... 3-80098

[51] Int. Cl.[5] ..... D05B 1/14; D05B 47/02

[52] U.S. Cl. ..... 112/168; 112/254

[58] Field of Search ..... 112/2, 34, 36, 155, 112/162, 163, 165, 166, 168, 172, 197, 199, 201, 202, 246, 248, 254, 255, 258, 259, 260, 288, 296, 298, 315

[56] References Cited

U.S. PATENT DOCUMENTS

| | | | |
|---|---|---|---|
| 1,100,913 | 6/1914 | Ringe | 112/168 X |
| 3,428,008 | 2/1969 | Casas-Robert | 112/168 |
| 3,675,603 | 7/1972 | Yamashita | 112/168 |
| 3,996,866 | 12/1976 | Bianchi | 112/254 |
| 4,303,028 | 12/1981 | Takenoya et al. | 112/168 X |
| 4,340,003 | 7/1982 | Hanyu et al. | 112/254 X |
| 4,343,250 | 8/1982 | Hanyu et al. | 112/168 |
| 4,498,405 | 2/1985 | Hanyu et al. | 112/168 X |
| 4,690.080 | 9/1987 | Mikuni et al. | 112/168 X |
| 4,967,677 | 11/1990 | Seriki et al. | 112/168 |
| 5,042,407 | 8/1991 | Jimenez | 112/254 |

FOREIGN PATENT DOCUMENTS

| | | | |
|---|---|---|---|
| 3065355 | 12/1988 | Japan | 112/168 |
| 2-154788 | 6/1990 | Japan . | |
| 1121333 | 10/1984 | U.S.S.R. | 112/168 |

*Primary Examiner*—Clifford D. Crowder
*Assistant Examiner*—Ismael Izaguirre
*Attorney, Agent, or Firm*—Lorusso & Loud

[57] ABSTRACT

A stitching mode changer for an overlock machine which enables stitching modes, i.e., ordinary overlock stitching, standard roll hemming, and special roll hemming, to be changed by a one-touch control operation and which is free from danger of an accident, e.g., breakage of a looper, due to erroneous operation. When a fabric feed dial is set to a feed rate for the ordinary overlock stitching, an adjusting member is flush with a needle plate, but, when the fabric feed dial is adjusted to a feed rate for the standard roll hemming, a cam that is secured to the dial rotates, so that a lever that abuts on the cam surface of the cam pivots, causing the adjusting member engaged with the lever to withdraw below the needle plate. The advance and withdrawal of the adjusting member are reliably effected by a combination of a spring and a retainer for guide, which are provided on a lower knife mount that supports the adjusting member. When the fabric feed dial is set to a feed rate for the special roll hemming, a thread tension changer is driven by a thread tension adjusting cam to activate an auxiliary thread tension controller for the lower looper thread so as to apply tension necessary for the special roll hemming.

5 Claims, 9 Drawing Sheets

(a)

(b)

MODE CHANGER WITH STITCH LENGTH, WIDTH, AND THREAD TENSION ADJUSTMENTS

BACKGROUND OF THE INVENTION

1. Field of the Invention

The present invention relates to a stitching mode changer designed to automatically change stitching modes of an overlock machine from ordinary overlock stitching to roll heming and vice versa.

2. Description of the Related Art

In general, overlock machines are designed to operate in two selective stitching modes, as shown in FIGS. 8 and 9, that is, ordinary overlock stitching in which the edge of a fabric cut by a knife is stitched with the needle thread and the upper and lower looper threads, and roll hemming in which the edge of a fabric cut is enfolded with the roll hemming. The roll hemming includes a variant in which the tension applied to the lower looper thread is increased, and the enfolded edge of a cut fabric is stitched with the upper looper thread.

To change the stitching mode from the ordinary overlock stitching to the roll hemming, it has heretofore been necessary to execute the following operations in a proper sequence: (1) the stitch width adjusting member is removed or withdrawn from the needle plate; (2) the stitch width is changed by operating the stitch width adjusting dial (cutting width adjusting dial); and (3) the fabric feed is changed to about 1 mm by adjusting the fabric feed dial. To change the standard roll hemming to the special roll hemming, an operation (4) of adjusting the tension of the lower looper thread is added to the above-described three operations.

The prior art suffers, however, from some problems. That is, since the stitching mode changing operation is complicated and requires skill and time, the prior art is unsuitable for unexperienced users. Even experienced users are likely to make a mistake in operation. In particular, since the stitch width adjusting member cannot be stably fixed after being advanced toward the needle plate, it is likely that the lower looper and the adjusting member will collide with each over during the sewing operation, resulting in breakage of the parts.

To simplify and automate the stitching mode changing operation, an automatic stitching changer has been proposed in which a stitch width adjusting member (thread slide member) is withdrawn in response to the operation of an lower knife adjusting dial, and a stitch balancing thread tension sensor is also activated in response to the operation of the adjusting dial so as to change the bobbin thread tension (see Japanese Patent Application Laid-Open (KOKAI) No. 02-154788 (1990)). With this automatic stitching changer, the operations (1), (2) and (4) in the above-described procedure are executed by the adjusting operation of the lower knife adjusting dial, and then the fabric feed is adjusted.

However, the above-described automatic stitching changer necessitates adjustment of the fabric feed as an extra operation. For this reason, if the user forgets to adjust the fabric feed to a level suitable for the ordinary overlock stitching after changing the roll hemming mode to the ordinary overlock stitching mode, since the configuration of the thread slide portion of the adjusting member is not suitable for small pitches in general, the forward movement of the fabric is retarded, so that the fabric may cause jamming. If the needle sticks in the fabric jammed in this way, the needle may break, and other problems may also arise, i.e., breakage of the thread slide of the fabric presser or the upper and lower loopers.

SUMMARY OF THE INVENTION

In view of the above-described problems of the prior art, it is an object of the present invention to provide a stitching mode changer for an overlock machine which enables stitching modes to be changed by a one-touch control operation and which is free from danger of an accident due to erroneous operation.

To this end, the present invention provides a stitching mode changer for an overlock machine, comprising: cam means secured to a fabric feed dial; a lever pivoted by the cam means; an adjusting member capable of advancing toward and withdrawing from a needle plate in response to the pivoting motion of the lever; and guide means for guiding the advance and withdrawal of the adjusting member.

Preferably, the adjusting member is slidably supported by a lower knife mount having a stitch width adjusting dial attached thereto so that when the lower knife mount is moved to adjust the stitch width by turning the stitch width adjusting dial, the adjusting member moves together with the lower knife mount as one unit.

The stitching mode changer for an overlock machine according to the present invention further comprises second cam means secured to the fabric feed dial, and thread tension changing means for changing tension applied to a pair of thread tension discs for a lower looper thread by the second cam means, so that the advance and withdrawal of the adjusting member and the adjustment of the tension applied to the lower looper thread are simultaneously effected in response to the rotation of the fabric feed dial for adjustment.

When a feed rate for overcast lock stitching is set by turning the fabric feed dial, the cam means that is secured to the fabric feed dial rotates together with the dial as one unit, so that the lever that abuts on this cam pivots so as to move the adjusting member in the direction in which it withdraws from the needle plate. When the fabric feed dial is set to a feed rate for ordinary overlock stitching, the lever is driven by the cam means so as to pivot in the direction reverse to the above, causing the adjusting member to advance toward the needle plate. Since the adjusting member moves while being guided by the guide means, the position of the adjusting member during and after the movement is surely regulated, so that there is no likelihood of collision with the lower looper or other parts.

After the fabric feed dial has been set to the roll hemming, the stitch width may be adjusted by turning the stitch width adjusting dial according to need. At this time, since the adjusting member moves together with the lower knife mount as one unit, the adjustment of the stitch width is extremely facilitated. In addition, when the fabric feed dial is set to the special roll hemming, the thread tension changing means is driven by the second cam secured to the fabric feed dial so as to increase the tension applied to the thread tension discs for the lower looper thread.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and of which.

DESCRIPTION OF THE PREFERRED EMBODIMENT

Figure 1:
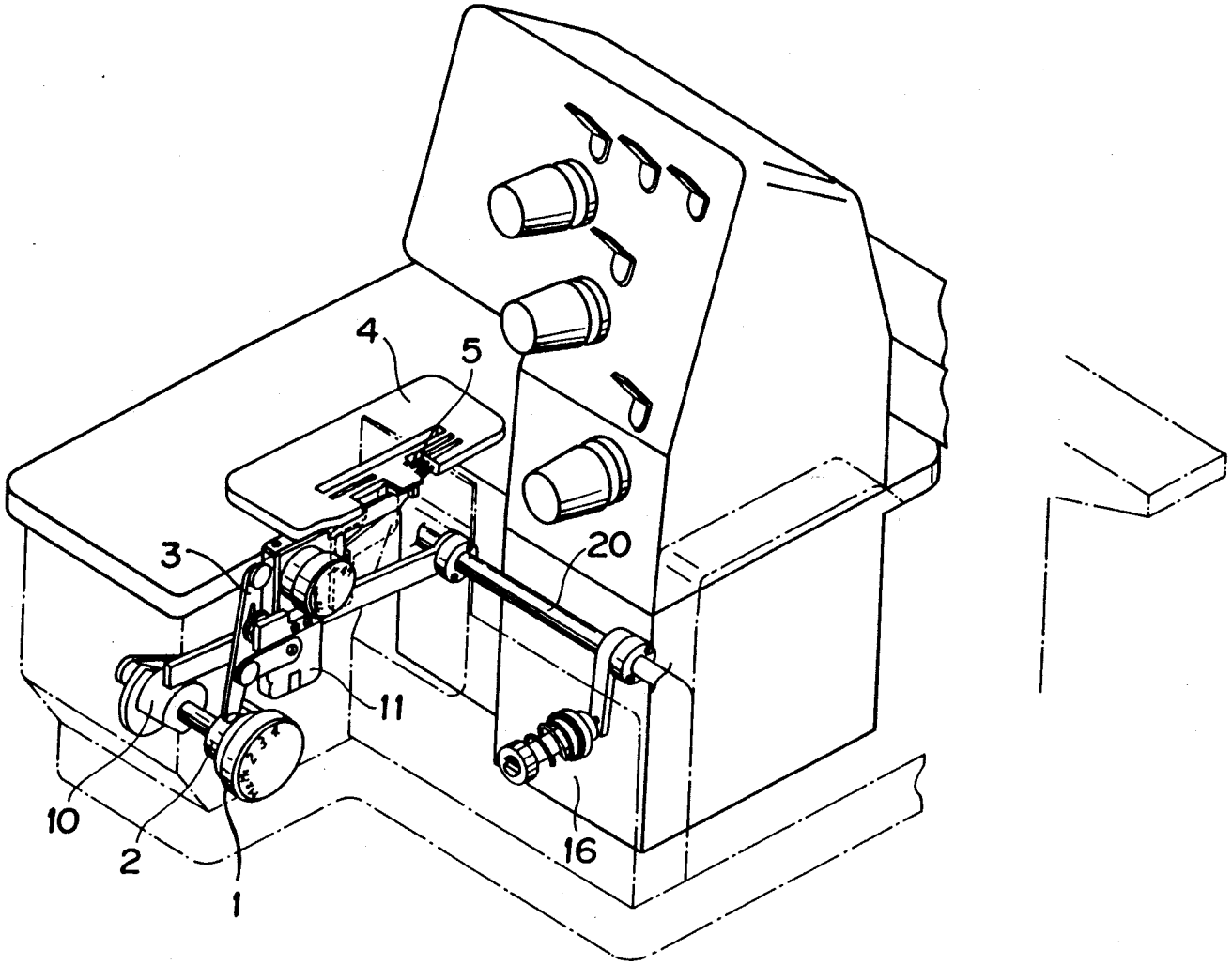
FIG. 1 is a perspective view of the stitching mode changer according to the present invention.

The stitching mode changer for an overlock machine according to the present invention will be described below in detail with reference to the accompanying drawings.

Referring to FIGS. 1 to 4, the stitching mode changer of the present invention comprises an adjusting member advancing and withdrawing cam 2, serving as a cam means, secured to a fabric feed dial 1, a pivotable lever 3 having one end portion thereof abutting on the cam surface of the cam 2, an adjusting member 5 engaged with a pin provided on the other end portion of the lever 3 so that the adjusting member 5 advances toward and withdraws from a needle plate 4 in response to the pivoting motion of the lever 3, and an adjusting member retainer 6, serving as a guide member, for guiding the advance and withdrawal of the adjusting member 5.

The fabric feed dial 1 is provided with a dial plate la indicating fabric feed rates, standard overcast lock stitching $M_1$ and special overcast lock stitching $M_2$. The fabric feed dial 1 is arranged to adjust a feed rod 9 through a stitch length adjusting shaft 7 and a stitch length adjusting plate 8 so that the fabric feed can be adjusted stepwise from 4 mm to 3 mm, 2 mm and 1 mm, which is used for the roll hemming (including both the standard and special roll hemming modes). The stitch length adjusting shaft 7 has a lower looper thread tension adjusting cam 10 secured thereto as a second cam means for adjusting the stitch balancing tension of the lower looper thread.

Figure 3:
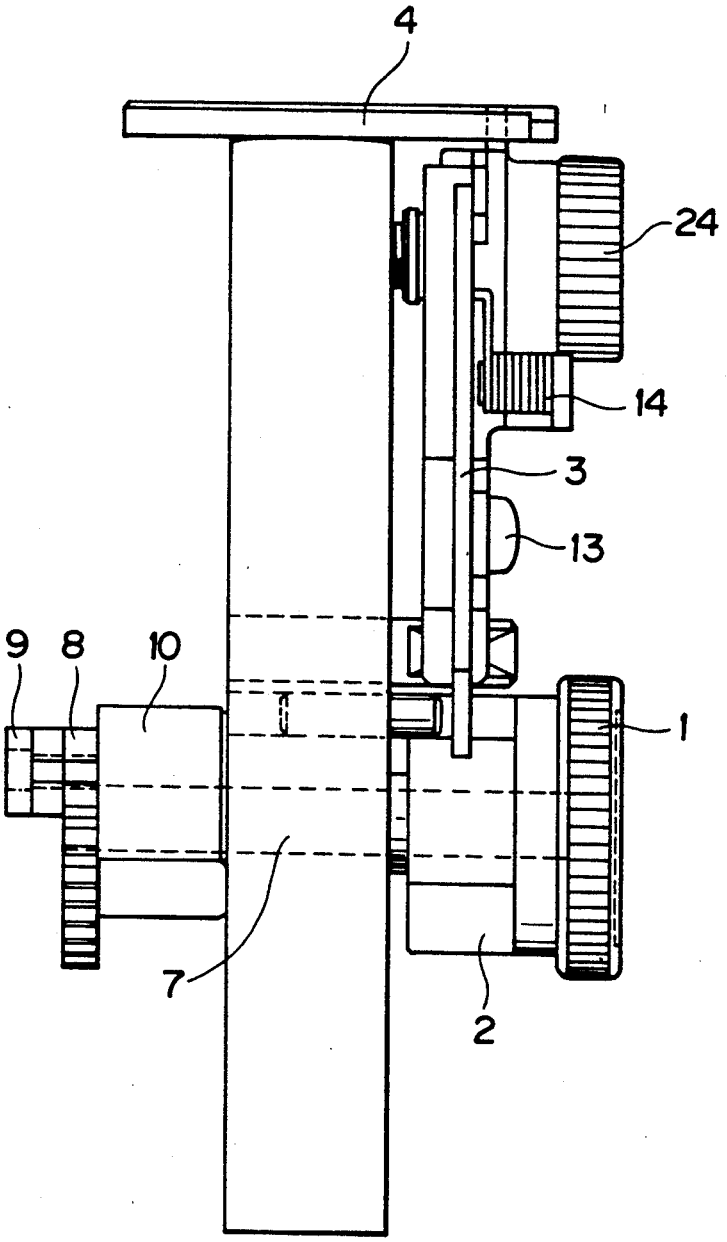
FIG. 3 is a front view of the stitching mode changer according to the present invention.
Figure 4:
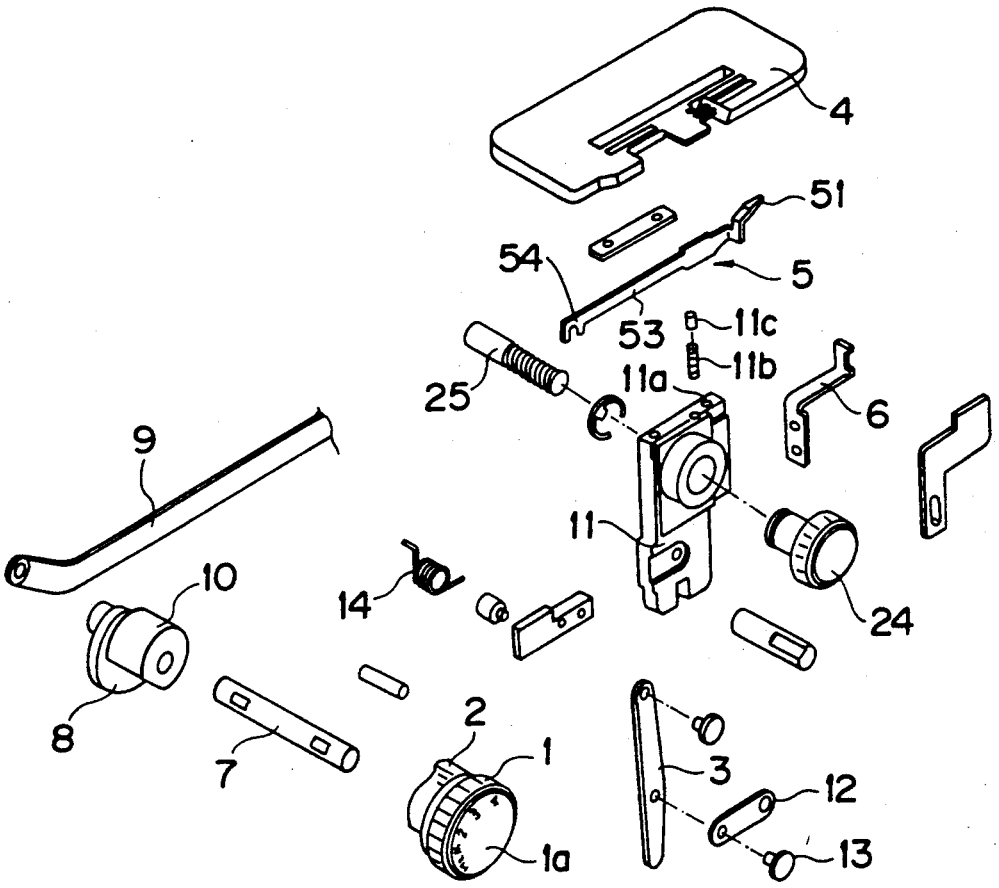
FIG. 4 is an exploded perspective view of the stitching mode changer according to the present invention, in which (a) shows the general arrangement, while (b) shows a cam means.
Figure 4B:
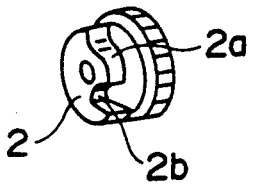

The cam surface of the advancing and withdrawing cam 2 that is secured to the fabric feed dial 1 is formed with a relatively shallow recess 2*a* and a relatively deep recess 2*b*, as shown at (b) in FIG. 4, so that, when the dial 1 rotates in the range of from the indication "4" to the indication "2", one end portion of the lever 3 abuts on the shallow recess 2*a*, whereas, when the dial 1 is in the range of from the standard roll hemming $M_1$ to the special roll hemming $M_2$, the end portion of the lever 3 abuts on the deep recess 2*b*. The cam surface has some width in the axial direction of the stitch length adjusting shaft 7, as shown in FIG. 3, so that, even when the lever 3 moves in response to the movement of a lower knife mount (described later), the contact between the lever 3 and the cam surface is surely maintained.

The lever 3 is pivotally attached to a fixed plate 12 secured to the lower knife mount 11 through a pin 13, so that the lever 3 can pivot about the pin 13. In addition, the lever 3 is biased by a coil spring 14 provided between the same and the lower knife mount 11 so that the other end portion of the lever 3 pivots counterclockwise as viewed in FIG. 2. Accordingly, when the first end portion of the lever 3 abuts on the shallow recess 2*a* of the advancing and withdrawing cam 2, the lever 3, which is regulated by the cam surface, is placed in the position shown in FIG. 2 (i.e., a position in which the adjusting member 5 is flush with the needle plate 4). However, when the first end portion of the lever 3 comes to abut on the deep recess 2*b* of the cam 2 in response to the rotation of the dial 1, the lever 3 is pivoted counterclockwise as viewed in the figure by the biasing force from the coil spring 14.

The adjusting member 5 comprises an adjusting portion 51, an enlarged-width portion 52, a support portion 53 and a driving portion 54. The adjusting portion 51 forms a thread slide portion as a part of the needle plate 4 when the adjusting member 5 is in the advance position. When the adjusting member 5 is withdrawn, a slant upper end portion that is formed between the adjusting portion 51 and the supporting portion 53 is pushed down by a slant portion formed on the bottom of the needle plate 4, so that the adjusting member 5 retracts to a withdrawn position below the needle plate 4. The support portion 53 is slidably supported by the lower knife mount 11 and biased upward by a spring 11*b*, which is fitted into a hole 11*a* provided in the lowerknife mount 11, together with a pin 11*c* (see at (a) in FIG. 4), thereby preventing vertical oscillation of the adjusting member 5 when advanced and withdrawn, and thus avoiding collision with the lower looper and breakage of the parts. The enlarged-width portion 52 places the adjusting member 5 in the withdrawn position by a step 52*a* defined between the same and the support portion 53. The enlarged-width portion 52 is reduced in width at the side thereof which is closer to the adjusting portion 51 so that a step 52*b* is formed at the upper end of the enlarged-width portion 52, while a slant portion 52*c* is formed at the lower end thereof. The step 52*b* at the upper end places the adjusting member 5 in the advance position by abutting against the retainer 6, while the slant portion 52*c* at the lower end enables the adjusting member 5 to be reliably held in the advance position by riding on a guide portion of the retainer 6. The driving portion 54 has a U-shaped configuration, and the U-shaped portion is engaged with a pin 15 that is provided on the second end portion of the lever 3. Thus, the driving portion 54 moves horizontally as viewed in FIG. 2 in response to the pivoting motion of the lever 3, thus causing the adjusting member 5 to advance and withdraw.

Figure 2:
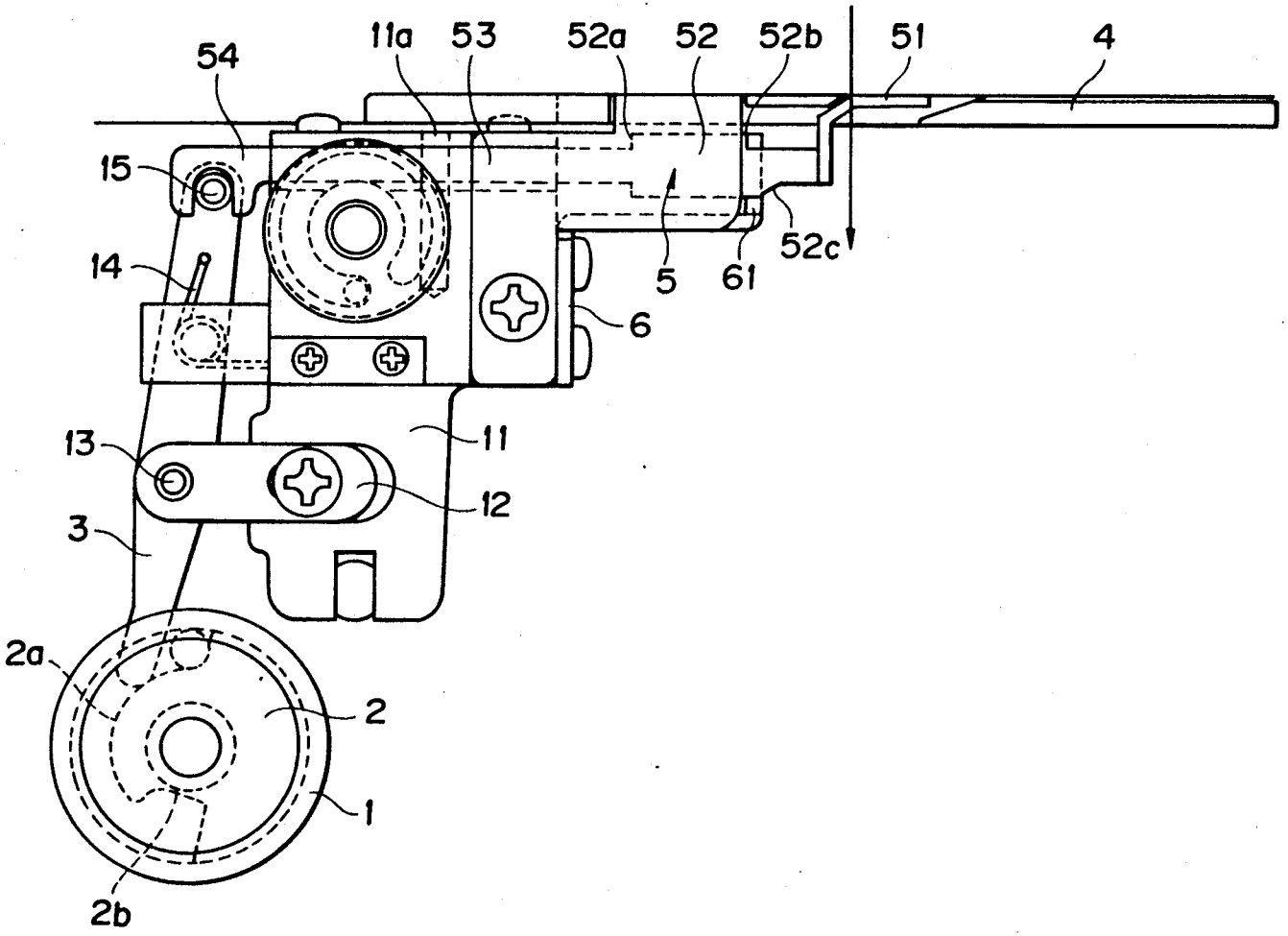
FIG. 2 is a side view of the stitching mode changer according to the present invention.

The retainer 6 is secured to a side surface of the lower knife mount 11. The retainer 6 supports the adjusting member 5 and guides the movement thereof with a U-shaped guide portion 61. When the adjusting member 5 is in the advance position, the lower end of the enlarged-width portion 52 lies on the guide portion 61, as shown in FIG. 2, and the upper end of the enlarged-width portion 52 is engaged with the guide portion 61, thereby regulating the vertical position of the adjusting member 5. In addition, the step 52*b* abuts against the guide portion 61, thereby limiting the movement of the adjusting member 5 in the direction in which it advances, and thus placing the adjusting member 5 in position. Since the adjusting member 5 is reliably positioned in this way, it is possible to avoid collision with the lower looper. When the adjusting member 5 retracts, the slant upper end portion of the adjusting member 5 is pushed down by the slant portion of the bottom of the needle plate 4 against the biasing force from the spring 11*b* in the lower knife mount 11, so that the adjusting member 5 is withdrawn below the needle plate 4. At this time, the step 52*a* of the enlarged-width portion 52 abuts against the side surface of the lower knife mount 11, thereby limiting the movement of the adjusting member 5 in the direction in which it withdraws, and thus allowing the adjusting member 5 to be surely placed in the withdrawal position.

Figure 5:
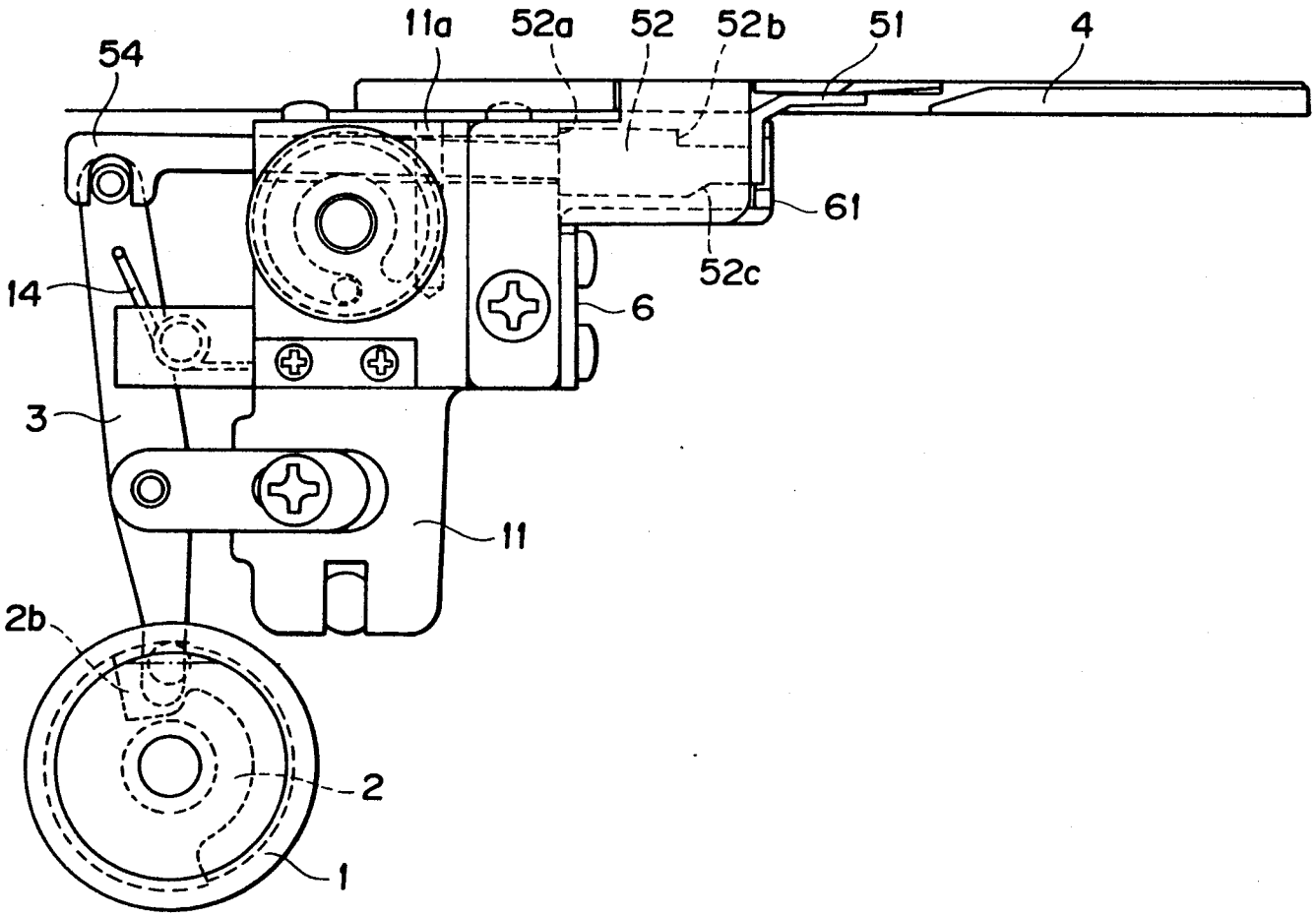
FIG. 5 is a side view showing the operation of the stitching mode changer according to the present invention.

With this arrangement, when the fabric feed dial 1 is set at any of the feed rates "2" to "4" for the ordinary overlock stitching, the first end portion of the lever 3 abuts on the shallow recess 2*a* of the advancing and withdrawing cam 2, thereby preventing the lever 3 from pivoting counterclockwise, and thus allowing the adjusting portion 51 of the adjusting member 5 to be held in the advance position (see FIG. 2) at which it is flush with the needle plate 4. Since the adjusting member 5 is held in position by the retainer 6, there is no likelihood of the adjusting member 5 becoming unstable even when it is pressed by the fabric. When the fabric feed dial 1 is set at either the standard roll hemming $M_1$ or the special roll hemming $M_2$, the first end portion of the lever 3 engages with the deep recess 2*b* of the cam 2, so that the lever 3, biased by the coil spring 14, is allowed to pivot counterclockwise. In consequence, the adjusting member 5 engaged with the second end portion of the lever 3 withdraws from the needle plate 4. This withdrawal takes place as follows. First, the adjusting member 5 moves backward with the slant portion of the adjusting portion 51 being pushed down by the slant portion of the needle plate 4 against the biasing force from the spring 11*b*, and then the step 52*a* of the enlarged-width portion 52 abuts against the side surface of the lower knife mount 11 to define the backward position of the adjusting member 5, thus placing it in a predetermined withdrawal position (see FIG. 5). When the fabric feed dial 1 is reset to a fabric feed for the ordinary overlock stitching, the lower end of the enlarged-width portion 52 of the adjusting member 5 readily rides on the guide portion 61 of the retainer 6 through the slant portion 52*c*, and the step 52*b* abuts against the guide portion 61, thus placing the adjusting member 5 in a predetermined advance position.

Figure 6A:
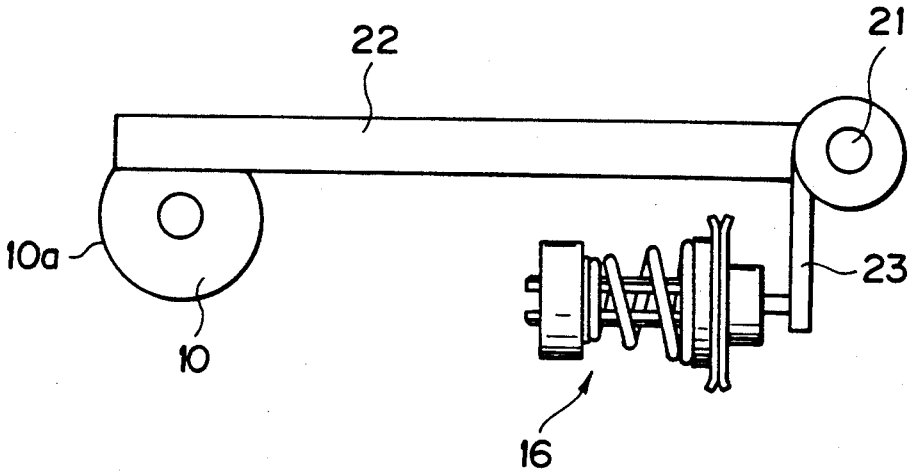
FIG. 6 is a side view showing a part of the stitching mode changer according to the present invention, in which (a) and (b) show the arrangement in two different stitching modes, respectively.
Figure 6B:
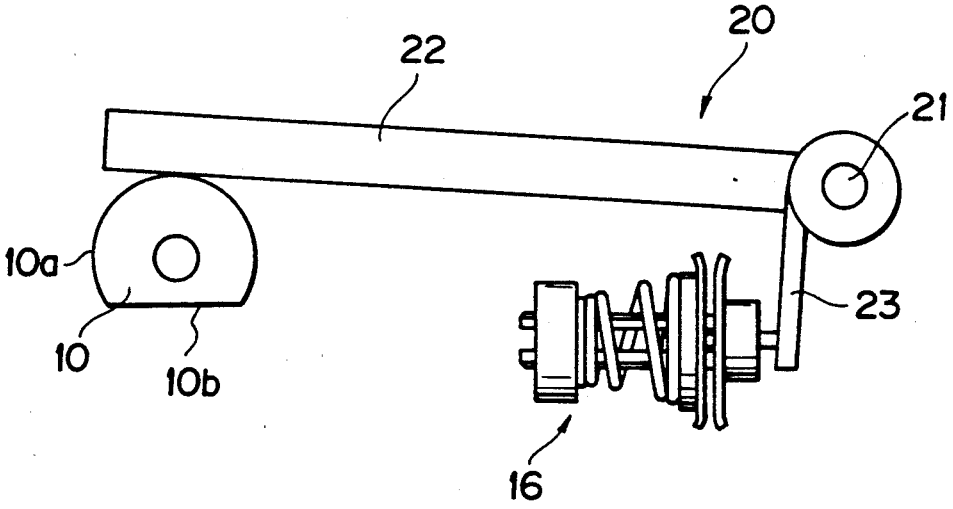
Figure 7A:
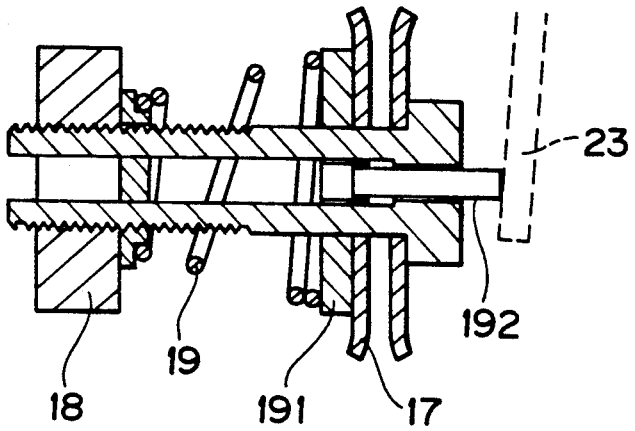
FIG. 7 is a sectional view showing an auxiliary thread tension controller for a lower looper thread, in which (a) and (b) show the arrangement in two different stitching modes, respectively.
Figure 7B:
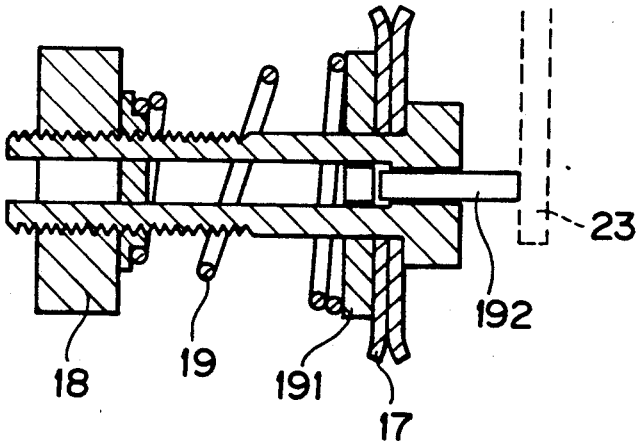
Figure 8:
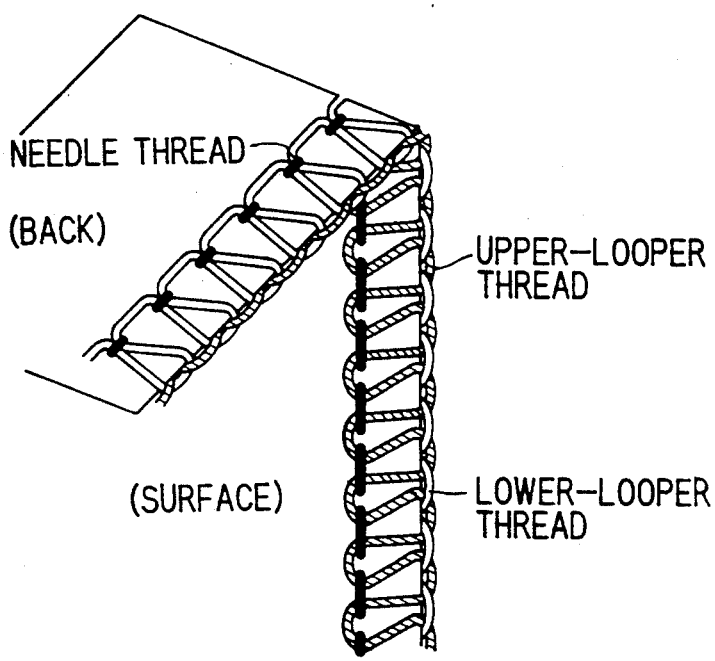
FIG. 8 shows ordinary overlock stitching.
Figure 9:
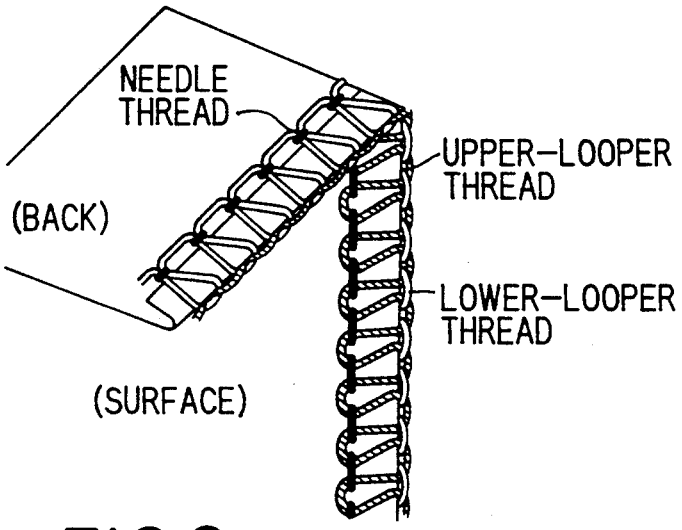
FIG. 9 shows roll hemming, in which (a) shows standard roll hemming, while (b) shows special roll hemming.
Figure 9:
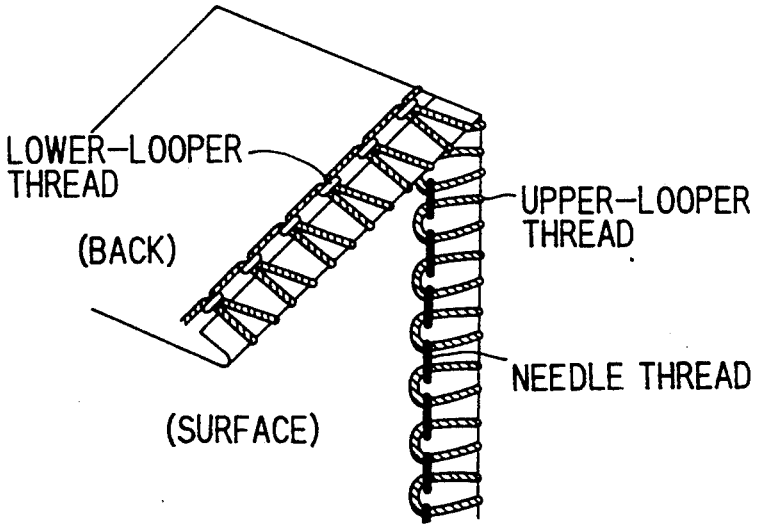

Adjustment of the lower looper thread will next be explained. Adjustment of the lower looper thread that is needed when the stitching modes are changed is realized by a combination of the thread tension adjusting cam 10 secured to the stitch length adjusting shaft 7 and a thread tension changing means 20 which is activated by the thread tension adjusting cam 10 so as to change the tension applied by a pair of thread tension discs 17 of an auxiliary thread tension controller 16 for the lower looper thread, as shown in FIGS. 1 and 6. Referring to FIG. 7, the auxiliary thread tension controller 16 comprises a pair of thread tension discs 17 for applying tension to the lower looper thread, a knob 18 for adjusting the tension applied by the thread tension discs 17, a thread tension spring 19 provided in between the thread tension discs 17 and the knob 18, a retaining plate 191 interposed between the thread tension discs 17 and the thread tension spring 19, and a pin 192 that presses the retaining plate 191. Normally (i.e., in either the ordinary overlock stitching mode or the standard roll hemming mode), the pin 192 is pressed by the thread tension changing means 20, so that the thread tension discs 17 are released from the biasing force of the thread tension spring 19, as shown at (a) in FIG. 7. Accordingly, the tension of the lower looper thread is adjusted only by a lower looper thread tension controller (not shown). In the case of the special roll hemming, the thread tension changing means 20 does not press the pin 192, as shown at (b) in FIG. 7, so that tension is applied to the thread tension discs 17 by the biasing force from the thread tension spring 19. The level of tension can be adjusted by turning the knob 18.

The thread tension changing means 20 comprises a shaft 21 secured to the machine body, a driving plate 22 secured to the shaft 21 and abutting at one end thereof against the cam surface of the thread tension adjusting cam 10, and a pressure plate 23 secured to the shaft 21 to press the thread tension discs 17 through the shaft of the auxiliary thread tension controller 16. The cross-section of the thread tension adjusting cam 10 has a circular portion 10*a* and a plane portion 10*b*, as shown at (b) in FIG. 6. Normally, the driving plate 22 abuts on the circular portion 10*a* of the thread tension adjusting cam 10 (see (b) in FIG. 6). However, when the fabric feed dial 1 is turned to the position for the special roll hemming $M_2$, the plane portion 10*b* comes in contact with the driving plate 22 (see (a) in FIG. 6). More specifically, when the fabric feed dial 1 is set to the special roll hemming $M_2$, one end of the driving plate 22 which abuts on the thread tension adjusting cam 10 lowers. In consequence, the shaft 21 and the pressure plate 23 rotate together as one unit, so that the pressure plate 23 moves away from the pin 192. Thus, the thread tension discs 17 are pressed by the biasing force from the thread tension spring 19 so as to apply tension necessary for the special roll hemming.

When the fabric feed dial 1 is set at any position, exclusive of the special roll hemming $M_2$, (i.e., in a normal case), the driving plate 22 is raised by the circular portion 10*a* of the thread tension adjusting cam 10. Therefore, the driving plate 22 and the pressure plate 23 pivot in the direction reverse to the above, pressing the pin 192 through the retaining plate 191 so as to push back the thread tension spring 19, thereby releasing the thread tension discs 17 from the biasing force. In other words, the auxiliary thread tension controller 16 returns to the state where there is only the tension applied by the thread tension controller for the lower looper thread.

As has been described above, the stitching modes can be changed from the ordinary overlock stitching to the roll hemming simply by setting the fabric feed dial 1 to the roll hemming. That is, it is possible to change the fabric feed, withdraw the adjusting member and, if necessary, adjust the tension applied to the lower looper thread by a one-touch control operation. In the case of the roll hemming, the fabric cutting width (knife cutting width) is set to a relatively large value in general. Therefore, when the fabric cutting width needs to be changed, a stitch width adjusting dial 24 is turned so as to move the lower knife mount 11 in the axial direction of a shaft 25 of the dial 24. In this case, since the support portion 53 is supported by the lowerknife mount 11, the adjusting member 5 moves in the axial direction of the shaft 25 together with the under cutting knife mount 11, so that the lever 3 also moves in the same direction simultaneously. At this time, since the advancing and withdrawing cam 2 has some thickness in the direction of movement thereof, there will be no interference with the changing operation. Even if the user forgets to adjust the stitch width at the time of changing the stitching modes by turning the fabric feed dial 1, there is no possibility of producing an adverse effect on the movement of the needle and the lower looper.

To adjust the position of the adjusting member 5, the first end portion of the lever 3 is placed in contact with the shallow recess 2*a* of the advancing and withdrawing cam 2 in a state where the enlarged-width portion 52 of the adjusting member 5 abuts against the guide portion 61 of the retainer 6, and in this state the fixed plate 12 of the lever 3 is secured to the lower knife mount 11.

Although in this embodiment the adjustment of the tension applied to the lower looper thread is effected by the auxiliary thread tension controller for the lower looper thread, it should be noted that the lower looper thread tension controller may be adjusted directly, as a matter of course.

As will be clear from the foregoing embodiment, in the stitching mode changer for an overlock machine according to the present invention, a dial for adjusting the fabric feed is provided with two cam means, and an adjusting member advancing and withdrawing mechanism and a lower looper thread tension changing mechanism are interlocked with the fabric feed adjusting dial. Accordingly, the stitching modes can be changed by a one-touch control operation. Thus, the operability is extremely superior, and it is possible to prevent an accident due to an erroneous operation.

In addition, according to the stitching mode changer of the present invention, the advancing and withdrawing operation of the adjusting member and the positioning of the adjusting member in fixed positions are ensured by specifying the respective configurations of the adjusting member and the guide means. There is therefore no likelihood that the adjusting member will collide with the lower looper during the operation, resulting in breakage of the parts. In addition, the stitching mode changer of the present invention facilitates the adjustment of the position of the adjusting member.

Although the present invention has been described through specific terms, it should be noted that the described embodiment is not necessarily exclusive and that various changes and modifications may be imparted thereto without departing from the scope of the invention which is limited solely by the appended claims.

What is claimed is:

1. A stitching mode changer for an overlock machine comprising:

a needle plate;

a lever;

cam means for engaging and imparting a pivoting motion to said lever;

a fabric feed dial, secured to said cam means, and stitch length adjusting means for changing stitch length responsive to turning of said fabric feed dial;

a lower knife mount, a stitch width adjusting dial for changing stitch width and positioning means for moving said lower knife mount responsive to manual turning of said stitch width adjusting dial;

an adjusting member which is advanced toward and withdrawn from said needle plate in response to the pivoting motion of said lever, said adjusting member being slidably supported by said lower knife mount and moving together with said lower knife mount as one unit responsive to manual turning of said stitch width adjusting dial; and guide means for guiding the advance and withdrawal of said adjusting member.

2. The stitching mode changer of claim 1, wherein said lever is pivotally secured to said lower knife mount.

3. The stitching mode changer of claim 1, wherein said lower knife mount and said stitch width adjusting dial are coaxially mounted on a common shaft.

4. A stitching mode changer for an overlock machine comprising:

a needle plate;

a lever;

cam means for engaging and imparting a pivoting motion to said lever;

an adjusting member which is advanced toward and withdrawn from said needle plate in response to the pivoting motion of said lever;

guide means for guiding the advance and withdrawal of said adjusting member;

a fabric feed dial secured to said cam means, and stitch length adjusting means for changing stitch length responsive to turning of said fabric feed dial;

second cam means secured to said fabric feed dial for rotation therewith; and thread tension means comprising a pair of thread tension discs biased together by spring force for imparting a tension to a lower looper thread and means for changing said tension by relieving said spring force responsive to the rotation of said second cam means.

5. The stitching mode changer of claim 4, wherein said lever is pivotally secured to said lower knife mount.

* * * * *